US005763133A

United States Patent [19]

Ong et al.

[11] Patent Number: 5,763,133

[45] Date of Patent: Jun. 9, 1998

[54] TONER COMPOSITIONS AND PROCESSES

[75] Inventors: Beng S. Ong, Mississauga; Walter Mychajlowskij, Georgetown, both of Canada; Grazyna E. Kmiecik-Lawrynowicz, Fairport, N.Y.; Raj D. Patel; David J. Sanders, both of Oakville, Canada; Stephan V. Drappel, Toronto, Canada

[73] Assignee: Xerox Corporation, Stamford, Conn.

[21] Appl. No.: 825,451

[22] Filed: Mar. 28, 1997

[51] Int. Cl.[6] ..... G03G 9/087

[52] U.S. Cl. ..... 430/137; 430/110

[58] Field of Search ..... 430/137, 107, 430/110

[56] References Cited

U.S. PATENT DOCUMENTS

| | | | |
|---|---|---|---|
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,364,729 | 11/1994 | Kmiecik-Lawrynowicz et al. | 430/137 |
| 5,370,963 | 12/1994 | Patel et al. | 430/137 |
| 5,403,693 | 4/1995 | Patel et al. | 430/137 |
| 5,418,108 | 5/1995 | Kmiecik-Lawrynowicz et al. | 430/137 |
| 5,585,215 | 12/1996 | Ong et al. | 430/137 |
| 5,650,256 | 7/1997 | Veregin et al. | 430/137 |

*Primary Examiner*—John Goodrow
*Attorney, Agent, or Firm*—E. O. Palazzo

[57] ABSTRACT

A process for the preparation of toner comprising (i) blending (a) an aqueous pigment dispersion containing a first ionic surfactant and an optional charge control agent with (b) a latex blend comprised of linear polymer and crosslinked polymer particles, optional nonionic surfactant and a second ionic surfactant with a charge polarity opposite to that of said first ionic surfactant in said pigment dispersion;

(ii) heating the resulting mixture at about below the glass transition temperature (Tg) of the linear latex polymer to form toner sized aggregates; and (iii) subsequently heating said aggregate suspension about above the Tg of the linear latex polymer to effect fusion or coalescence of said aggregates.

31 Claims, No Drawings

TONER COMPOSITIONS AND PROCESSES

BACKGROUND OF THE INVENTION

The present invention is generally directed to toner processes, and more specifically, to chemical processes wherein there is accomplished the aggregation of latex, pigment particles, and optional additives to enable toner compositions. In embodiments, the present invention is related to the direct preparation of toner compositions without the need for conventionally known pulverization and classification methods, and wherein in embodiments toner compositions with a volume average diameter of from about 1 to about 15, and preferably from 2 to about 10 microns, and narrow particle size distribution as conventionally characterized by GSD (geometric standard deviation) of, for example, less than 1.35, more specifically, less than about 1.25, and, for example, from about 1.15 to about 1.25, as measured on the Coulter Counter, can be obtained. The resulting toners can be selected for known electrophotographic processes and printing processes, including digital processes, and particularly color xerographic imaging and printing processes. In embodiments, the present invention relates to a process for obtaining toner compositions with, for example, specific image gloss characteristics, and which process is comprised of aggregating a latex emulsion comprised of a mixture of linear polymer and crosslinked polymer particles, pigment and optional additive components into toner sized aggregates, followed by coalescing or fusing together the constituents of the aggregates to form integral composite toner particles, and which toner is comprised, for example, of the linear polymer, from about 50 to 90 weight percent, for example, the crosslinked polymer particles therein, from about 0.1 to about 70, and preferably from about 1 to about 50 weight percent, and pigment, for example from about 3 to about 15 weight percent. The image gloss characteristics of the toner compositions of the present invention in embodiments can be controlled primarily by the amount of the crosslinked polymer particles utilized, their particle size, crosslink density, and composition. Specifically, lower image gloss levels are obtained from toners with higher contents and larger particle size of crosslinked polymer. Accordingly, a wide range of image gloss level ranging from below about 20 to in excess of about 70 Gardner Gloss units (GGU) as measured by the Gardner Gloss metering instrument can be designed to provide specific image appearance requirements. In general, the image gloss requirement of a document is dictated by its application; for example, for process color, glossy images are highly desirable. For text, highlight and graphic documents, a matte image finish is generally preferred.

In embodiments of the present invention, the toner process is comprised of aggregating two latices, one comprised of linear polymer particles and the second of crosslinked polymer particles, with an aqueous pigment dispersion and optional charge additives at a temperature below about, or in embodiments equal to about the glass transition temperature (Tg) of the linear latex polymer, for example generally from about 25° C. to about 1 ° C. below the Tg, to form electrostatically bound aggregates, followed by coalescing or fusing together the constituents of the aggregates to form mechanically stable integral particles by heating at a temperature of from about 10° C. to about 50° C. above the Tg of the linear latex polymer for an effective time period, for example from about 30 minutes to about several, for example 25, hours. The latices that are utilized in the process of the present invention generally contain an ionic surfactant and an optional nonionic surfactant, and the pigment dispersion contains an ionic surfactant that is of an opposite charge polarity to the ionic surfactant in the latex emulsion. The mixing of the latices with the pigment dispersion permits flocculation of the latex and the pigment particles, which flocculent mixture on gentle stirring with controlled heating, enables the formation of toner sized aggregates with narrow particle size distribution. The latex size is generally in the range of from, for example, about 0.05 micron to about 2 microns in volume average diameter, while the pigment size is from, for example, about 0.05 micron to about 1.0 micron. The amount of each of the ionic surfactants utilized in the process in embodiments is from about 0.01 to about 5 weight percent, and the nonionic stabilizers are present in the latex emulsion in amounts of from about 0 to about 5 weight percent of the total reaction mixture. The resulting toners in embodiments possess a variety of image gloss characteristics with their image gloss levels being primarily determined by the amount of the crosslinked polymer particles present in the toner composition. In embodiments of the present invention, toners with image gloss values of, for example, from less than about 20, for example about 15, to over 70 GGU, for example about 80, can be obtained. The ability to adjust the image gloss of a toner is particularly important in color applications as proper gloss matching between image and paper is highly desirable. For example, when a low gloss image of less than about 30 GGU is desired, low gloss paper is utilized; in contrast, for process color applications where glossier coated paper is generally employed to enhance image appearance, higher gloss images with gloss levels of from about 50 to over about 80 GGU are preferred.

In embodiments thereof, the present invention is directed to a chemical toner process comprised of first blending by high shear mixing an aqueous pigment dispersion containing a pigment, such as HELIOGEN BLUE ™ or HOSTAPERM PINK™, and a cationic surfactant, such as benzalkonium chloride (SANIZOL B50™), with a latex blend containing two latices, one comprised of linear polymer particles and the other, or second of crosslinked polymer particles, stabilized with an anionic surfactant such as sodium dodecylbenzene sulfonate, for example NEOGEN R™ or NEOGEN SC™, and a nonionic stabilizer such as alkyl phenoxy poly(ethyleneoxy)ethanol, for example IGEPAL 897™ or ANTAROX 897™, and which latices have a particle size of from, for example about 0.05 to about 2.0 microns in volume average diameter as measured by the Brookhaven nanosizer, and optional additives; and wherein mixing of the latex emulsion, pigment dispersion, and optional additives induces flocculation of the latex, pigment, optional additive particles and surfactants, which flocculent mixture on heating at a temperature of from about 25° C. below to about 1° C. below the Tg of the linear latex polymer, results in the formation of electrostatically bound aggregates ranging in size of, for example, from about 2 microns to about 10 microns in volume average diameter as measured by the Coulter Counter. Subsequently, heating the aggregate suspension at about 10° C. to 50° C. above the Tg of the latex polymer in the presence of additional anionic surfactant converts the aggregates into mechanically stable toner particles. Toners prepared in accordance with the present invention enable in embodiments the generation of high quality images with specifically preselected image gloss levels; and permits lower fusing temperatures, such as from about 120° C. to about 170° C., thereby eliminating or minimizing paper curl while prolonging the life of fuser roll. The invention toners are particularly useful for the development of colored images with excellent (1) image resolution, (2) color fidelity, (3) gloss uniformity, and (4) projection efficiency.

PRIOR ART

In color xerographic systems, small sized toners of preferably from about 2 to about 7 microns are important to the achievement of high image quality essential for process color applications. It is also important to have a low image pile height to eliminate image feel and avoid, or minimize paper curling after fusing. Paper curling can be particularly pronounced in xerographic color processes in which relatively high toner coverage as a result of the application of three to four color toners. During the fusing step, moisture is driven off from the paper due to a high fusing temperatures of from about 120° to 200° C. With only one layer of toner, such as in one-color black or highlight color xerographic applications, the amount of moisture driven off during fusing can usually be reabsorbed back by the paper and the resulting print remains relatively flat with minimal paper curl. In process color processes where toner coverage is high, the relatively thick toner plastic covering on the paper can inhibit the paper from reabsorbing the moisture, and lead to substantial paper curling. These and other imaging shortfalls and problems are avoided or minimized with the toners and processes of the present invention.

It is preferable to use small toner particle sizes, such as from about 2 to 7 microns, and with higher pigment loading, such as from about 4 to about 15 percent by weight of toner, so that the mass of toner necessary for attaining the required optical density and color gamut can be significantly reduced to eliminate or minimize image feel and paper curl. The use of lower toner mass also ensures the achievement of image uniformity. Toners prepared in accordance with the present invention enable in embodiments the use of lower fusing temperatures, such as from about 120 to about 170° C., which temperatures will also eliminate or minimize the paper curling problem.

There is illustrated in U.S. Pat. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. Furthermore, there is illustrated in U.S. Pat. 4,797,339, a process for the preparation of toners by resin emulsion polymerization, wherein similar to the '127 patent certain polar resins are selected.

Emulsion/aggregation processes for the preparation of toners are illustrated in a number of patents, the disclosures of which are totally incorporated herein by reference, such as U.S. Pat. 5,290,654, U.S. Pat. 5,278,020, U.S. Pat. 5,308,734, U.S. Pat. 5,346,797, U.S. Pat. 5,370,963, U.S. Pat. 5,344,738, U.S. Pat. 5,403,693, U.S. Pat. 5,418,108, U.S. Pat. 5,364,729, and U.S. Pat. 5,346,797.

SUMMARY OF THE INVENTION

Examples of the objects of the present invention in embodiments thereof include:

It is an object of the present invention to provide toner processes with many of the advantages illustrated herein.

In another object of the present invention there are provided simple and economical processes for preparation of black and colored toner compositions with, for example, smaller particle size of about 2 to about 10 microns and narrow GSD of less than about 1.35, and more specifically, less than about 1.25.

A further object of the present invention is the provision of colored toner compositions with excellent pigment dispersion, thereby enabling excellent color mixing quality and projection efficiency.

Still in a further object of the present invention there are provided toner processes for colored toner compositions with image gloss characteristics that can be adjusted to, for example, satisfy customer image appearance requirements.

In a further object of the present invention there is provided a process for the preparation of toner compositions with a toner size of from between about 1 to about 15 microns, and preferably from about 2 to about 7 microns in volume average particle diameter, and a narrow GSD of less than about 1.35, and preferably less than about 1.25 as measured by a Coulter Counter, and wherein the toner image gloss characteristics can be adjusted.

Another object is the provision of a chemical process for the preparation of toner compositions with tunable image gloss properties and which process comprises the aggregation and coalescence of two latices, one with linear polymer particles, and a second with crosslinked polymer particles, a pigment, and optional additives, and wherein the toner particle size is achieved by, for example, control of the process temperature.

In still another object of the present invention there is provided a toner derived from a linear latex polymer, a crosslinked latex polymer, a pigment, and optional charge control agent, and wherein the toner has a narrow GSD of from less than about 1.35, and preferably less than about 1.25, and which process can be accomplished without known classifications.

In an associated object of the present invention there are provided toner compositions and images developed thereof, and wherein the image gloss characteristics are controlled by the nature and amount of the crosslinked polymer particles in the toner composition.

In a further associated object of the present invention there are provided toner compositions with image gloss levels of from below about 20 to over 70 GGU as measured by Gardner Gloss meter.

In yet another object of the present invention there are provided toner compositions which enable lower fusing temperatures of from about 120° C. to about 170° C., and which toners possess excellent toner blocking resistance.

Moreover, in another object of the present invention there are provided toner compositions with excellent image projection efficiency, such as from about 65 to over 80 percent as measured by the Match Scan II spectrophotometer available from Milton-Roy.

In a further object of the present invention there are provided toner compositions which, when properly fused on paper, avoid, or minimize paper curl; wherein gel, or crosslinked incorporated toners can be prepared, that is wherein the gel is embedded in the toner, and more specifically, wherein the gel is contained in the linear polymer, and wherein with such toners photoreceptor filming is minimized, and wire contamination on development wires is avoided or minimized; and wherein image gloss and image matte is achievable.

In embodiments the present invention relates to toners and processes thereof. In embodiments of the present invention, there are provided toner processes comprising the aggregation of latices, pigment, and additive particles to form toner sized aggregates, followed by fusion or coalescence of the constituents of the aggregates to form integral toner particles, and wherein the temperature of aggregation is utilized to control the aggregate size, and thus the final toner size, and wherein there is selected a mixture of two latices, one with a linear polymer and the second with a crosslinked polymer, for incorporation into the toner composition.

In embodiments, the present invention is directed to processes for the preparation of toner compositions which processes comprise initially blending an aqueous pigment dispersion containing a color pigment or pigments, such as carbon black like REGAL 330®, phthalocyanine, quinacridone or RHODAMINE B™, and a cationic surfactant, such as benzalkonium chloride, by means of a high shearing device, such as a Brinkmann polytron, or a sonicator or microfluidizer, with a mixture of two latices, one with a crosslinked polymer and one with a linear polymer, such as a styrene-butadiene resin, styrene-isoprene resin, styrene-acrylate resin, and the like, containing an anionic surfactant such as sodium dodecylbenzene sulfonate and a nonionic surfactant; heating the resultant flocculent mixture with stirring at a temperature of from about 25° C. to about 1° C. below the Tg of the linear latex polymer to form toner sized aggregates ranging in volume average volume diameter of from about 1 to about 15 micron, and preferably from about 2 to about 10 microns; and further heating the mixture at a temperature of from about 10° C. to 50° C. (Centigrade) above the Tg of the linear latex polymer to effect fusion or coalescence of the constituents of the aggregates and to form integral toner particles; followed by washing with, for example, water to remove, for example, surfactants, and drying such as by means of an oven, Aeromatic fluid bed dryer, freeze dryer, or spray dryer; whereby toner particles of particle size of from about 1 to about 15 microns in volume average particle diameter and GSD of less than 1.35 as measured by the Coulter Counter, and with image gloss values of from less than 20 to over 70 GGU are obtained. The resulting toners comprise the linear polymer and therein the crosslinked polymer, pigment, and optional toner additives.

Embodiments of the present invention include a process for the preparation of toner compositions comprised of linear and crosslinked polymer particles, and pigment, and which process comprises (i) blending a pigment dispersion containing an ionic surfactant with a latex emulsion comprised of (a) a linear polymer, that is for example, a polymer that is not crosslinked, (b) a crosslinked polymer, and (c) a nonionic surfactant and an ionic surfactant that is of opposite charge polarity to the ionic surfactant in the pigment dispersion;

(ii) heating the resulting homogenized mixture at a temperature of from about 25° C. to about 1° C. below the Tg of the linear latex polymer, thereby effecting the formation of toner sized aggregates with, for example, a volume average diameter of from about 2 to about 10 microns, and a GSD of less than 1.35, and preferably less than 1.25; and thereafter (iii) heating the aggregate suspension with additional ionic surfactant of opposite charge polarity to the surfactant of the pigment dispersion to, for example, from about 60° C. to about 110° C. to primarily permit fusion or coalescence of the constituents, or components of the aggregates to form integral toner particles; and subsequently (iv) isolating the toner product by washing and drying using appropriate conventional methods, such as washing with water, and solvents, and drying in an over.

In embodiments, the present invention relates to a process for the preparation of toner with, for example, controlled particle size comprising (i) preparing an aqueous pigment dispersion comprised of a pigment, an ionic surfactant and optionally a charge control agent;

(ii) mixing the pigment dispersion with a latex blend comprised of linear polymers and crosslinked polymer particles, a nonionic surfactant and an ionic surfactant with a charge polarity opposite to that of the ionic surfactant in the pigment dispersion, thereby causing flocculation of latex, pigment and optional additive particles;

(iii) heating the resulting flocculent suspension at a temperature of, for example, from about 25° C. to about 1° C. below the Tg (glass transition temperature) of the linear latex polymer, while continuously stirring to effect formation of relatively stable toner sized aggregates of latex, pigment, and optional charge additive particles;

(iv) heating the resulting aggregate suspension with additional surfactant of opposite charge of the pigment surfactant at temperatures of from about 5° C. to 50° C. (Centigrade) above the resin Tg of, for example, from about 45° C. to about 65° C. to enable fusion of coalescence of the aggregate components to form mechanically stable, and morphologically useful forms of the toner comprised of polymer resin, crosslinked polymer, pigment and optionally a charge control agent;

(v) separating the toner particles from water by filtration; and (vi) drying the toner particles.

Examples of embodiments of the present invention are a process for the preparation of toner comprising (i) blending (a) an aqueous pigment dispersion containing a first ionic surfactant and an optional charge control agent with (b) a latex blend comprised of linear polymer and crosslinked polymer particles, optional nonionic surfactant and a second ionic surfactant with a charge polarity opposite to that of said first ionic surfactant in said pigment dispersion;

(ii) heating the resulting mixture at about below the glass transition temperature (Tg) of the linear latex polymer to form toner sized aggregates; and (iii) subsequently heating said aggregate suspension about above the Tg of the linear latex polymer to effect fusion or coalescence of said aggregates; a process wherein the temperature at which the aggregates are formed in step (ii) controls the size of said aggregates to be in the range of from about 2 to about 10 microns in volume average diameter, and wherein said coalescence of step (iii) provides mechanically stable integral toner particles; a process wherein the crosslinked polymer is a crosslinked linear polymer; a process wherein the crosslinked polymer is selected from the group consisting of a crosslinked poly(styrene-alkyl acrylate), poly(styrene-butadiene), poly(styrene-isoprene), poly (styrene-alkyl methacrylate), poly(styrene-alkyl acrylate-acrylic acid), poly(styrenebutadiene-acrylic acid), poly(styrene-isoprene-acrylic acid), poly (styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrileacrylic acid), and a crosslinked poly(alkyl acrylate-acrylonitrile-acrylic acid); a process wherein the crosslinked polymer particles are present in an amount of from about 0.1 to about 70 weight percent, or preferably from about 1 to about 50 weight percent of the toner; a process wherein the crosslinked polymer particles are present in an amount of from about 20 to about 50 weight percent of the toner; a process wherein the linear polymer is present in an amount of from about 25 to about 95 weight percent of the toner; a process in accordance wherein the linear polymer is present in an amount of from about 50 to about 90 weight percent of the toner; a process wherein the resulting toner has an image gloss value of from about 5 to about 60 GGU at the toner's minimum fix temperature (MFT), which temperature is from about 120° to about 185° C.; a process wherein the toner possesses an image gloss value of from about 10 to about 70 GGU at the toner MFT of from about 120° to about 185° C., and which gloss value is enabled by the presence of from about 0.1 to about 70 weight percent of crosslinked polymer particles in the toner; a process wherein the surfactant in the aqueous pigment dispersion is a cationic surfactant, and the surfactant in the latex blend is nonionic and anionic surfactants; a process wherein the surfactant in the pigment dispersion is an anionic surfactant and the surfactant in the latex blend is nonionic and cationic surfactants; a process wherein the aqueous pigment dispersion is prepared by homogenizing a pigment in water in the presence of a suitable surfactant, which homogenizing is at from about 1,000 revolutions per minute to about 10,000 revolutions per minute at a temperature of from about 25° C. to about 55° C., and for a duration of from about 1 minute to about 120 minutes; a process wherein the pigment dispersion is prepared by mixing a pigment in a suitable surfactant in water using an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes; a process wherein the aggregation step (ii) is accomplished at temperatures of from about 25° C. to about 1 ° C. below the Tg of the linear polymer for a duration of from about 0.5 hour to about 6 hours; a process wherein the linear polymer is selected from the group consisting of poly (styrene-butadiene), poly(methyl methacrylate-butadiene), poly(ethyl methacrylate-butadiene), poly (propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly (methyl acrylate-isoprene), poly(ethyl acrylate-isoprene), poly(propyl acrylate-isoprene), poly(butyl acrylate-isoprene), poly(styrene-butylacrylate), poly (styrene-butadiene), poly(styrene-isoprene), poly (styrene-butyl methacrylate), poly(styrene-butyl acrylate-acrylic acid), poly(styrene-butadiene-acrylic acid), poly(styrene-isoprene-acrylic acid), poly (styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and the crosslinked polymer is comprised of the linear polymer with crosslinking; a process wherein the linear polymer is poly(styrene-butylacrylate), poly (styrene-butyl acrylate-acrylic acid), poly(styrene-butadiene), poly(styrene-butadiene-acrylic acid), poly (styrene-butyl acrylate-acrylonitrile), or poly(styrene-butyl acrylate-acrylonitrile-acrylic acid), and the crosslinked resin is the crosslinked derivative of poly (styrene-butyl acrylate), poly(styrene-butyl acrylate-acrylic acid), poly(styrene-butadiene), poly(styrene-butadiene-acrylic acid), poly(styrene-butyl acrylate-acrylonitrile), or poly(styrene-butyl acrylate-acrylonitrile-acrylic acid); a process wherein the linear polymer is selected from the group consisting of poly (styrene-butadiene), poly(methyl methacrylate-butadiene), poly(ethyl methacrylate-butadiene), poly (propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly (methyl acrylate-isoprene), poly(ethyl acrylate-isoprene), poly(propyl acrylate-isoprene), poly(butyl acrylate-isoprene), poly(styrene-butylacrylate), poly (styrene-butadiene), poly(styrene-isoprene), poly (styrene-butyl methacrylate), poly(styrene-butyl acrylate-acrylic acid), poly(styrene-butadiene-acrylic acid), poly(styrene-isoprene-acrylic acid), poly (styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and wherein the crosslinked polymer is contained, or dispersed in the linear polymer; a process wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; a process wherein the anionic surfactant is selected from the group consisting of sodium dodecyl sulfate, sodium dodecylbenzene sulfate, sodium dodecylnaphthalene sulfate, and the cationic surfactant is a quaternary ammonium salt; a process wherein the pigment is carbon black, magnetite, cyan, yellow, magenta pigment, and mixtures thereof; a process wherein the surfactants are each present in an effective amount of from about 0.1 to about 5 weight percent of the reaction mixture; a process wherein there is added to the surface of the formed toner metal salts, metal salts of fatty acids, silicas, metal oxides, or mixtures thereof in an effective amount of, for example, from about 0.1 to about 10 weight percent of the obtained toner particles; a process wherein the toner is washed with water or aqueous base at a temperature of from about 25° C. to about 75° C. primarily to remove the residual surfactants from the toner; a process wherein the fusion or coalescence step (iii) is accomplished at a temperature from about 10° C. to about 50° C. above the Tg of the linear noncrosslinked resin, and wherein the heating in the coalescence step (iii) is accomplished at a temperature of about 80° C. to about 100° C.; a process for the preparation of toner comprising heating (a) a mixture of an aqueous pigment dispersion containing a first ionic surfactant, and (b) a latex blend comprised of linear noncrosslinked polymer and crosslinked polymer, a nonionic surfactant, and a second ionic surfactant with a charge polarity opposite to that of said first ionic surfactant in said pigment dispersion; heating the resulting mixture below the glass transition temperature (Tg) of the linear noncrosslinked polymer to form toner aggregates; and subsequently heating said aggregates above the Tg of the linear latex polymer to effect coalescence of the aggregates; and toners obtained by the processes illustrated herein.

Embodiments of the present invention include a process wherein the pigment dispersion contains a pigment with a volume average diameter of from about 0.01 to about 1 micron, a latex blend contains from about 1 to about 70 percent by weight of crosslinked latex, and which latex size ranges from about 0.05 to about 1 micron in volume average diameter.

In embodiments, the toner composition generated contains from about 25 to about 95, and more specifically from about 50 to about 90 weight percent of the linear polymer, from about 0.1 to about 70, and preferably from 1 to about 50 weight percent of the crosslinked polymer, preferably contained in the linear polymer, from about 1 to about 15, or from about 3 to about 15, and more specifically, from 5 to about 12 weight percent of pigment, or pigment blend, and from about 0.1 to about 5 weight percent of charge control agent.

Illustrative examples of linear latex polymers selected for the process of the present invention include known addition polymers such as poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butylacrylate-butadiene), poly(styrene-isoprene), poly (methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly (butylacrylate-isoprene), poly(styrene-butylacrylate), poly (styrene-propyl acrylate), poly(styrene-ethyl acrylate, poly (styrene-butylacrylate-acrylic acid), poly(styrene-propyl acrylate-acrylic acid); polymers such as poly(styrene-butadiene-acrylic acid), poly(styrene-butadiene-methacrylic acid), PLIOTONE™ available from Goodyear, and the like. The linear polymers and crosslinked latex polymers selected, which in embodiments can be poly(styrene-acrylates), poly(styrene-butadienes), or poly(styrene-methacrylates) are present in various effective amounts, such as from about 85 weight percent to about 98 weight percent of the toner composition, and which latex size can be, for example, of about 0.01 micron to about 2 micron in average volume diameter as measured by the Brookhaven nanosize particle analyzer.

Examples of crosslinked polymers selected are generally similar to those of the linear polymers in chemical composition except for the crosslinked structure. Crosslinked polymers include additional crosslinked polymers derived from the emulsion polymerization of vinyl monomers selected preferably from the group consisting of styrene and its derivatives, dienes, acrylates, and methacrylates. Examples of acrylates include methyl acrylate, ethyl acrylate, propyl acrylate, butyl acrylate, pentyl acrylate, ethylhexyl acrylate and the like, while examples of methacrylates include methyl methacrylate, ethyl methacrylate, propyl methacrylate, butyl methacrylate, and the like. The crosslinker, such as divinyl benzene, is present in an effective amount of from, for example, about 0.01 percent by weight to about 25 percent by weight, with the preferred amount ranging from about 0.5 to about 10 percent by weight. Examples of linear polymers selected are similar to, or the same as the crosslinked polymers with the exception that the linear polymers are free of crosslinking.

The image gloss characteristics provided by the toners of the present invention are dependent, for example, on the particle size, amount and crosslink density of the crosslinked latex polymer. In embodiments of the present invention, an effective crosslink density of the latex is provided by incorporating from about 0.01 to about 25 weight percent of a divinyl monomer, such as divinyl benzene, during the emulsion polymerization.

Also, in embodiments of the present invention there can be obtained toners which provide matte images of gloss values of less than about 20, and more specifically, from about 10 to about 20 GGU by incorporating a higher percentage of the crosslinked latex particles of, for example, from about 30 to over 50, and more specifically, about 50 weight percent of the toner composition.

The pigment dispersion depends primarily on the form of the pigment utilized. In some instances, pigments available in the wet cake form or concentrated form containing water can be easily dispersed in water in the presence of suitable surfactants by high shear mixing or homogenization. Also, the pigments are available in a dry form, whereby dispersion in water is preferably effected by microfluidizing using, for example, an M-110 microfluidizer and passing the pigment dispersion from about 1 to about 10 times through the chamber of the microfluidizer, or by sonication, such as using a Branson 700 sonicator, with the optional addition of dispersing agents such as by utilizing the aforementioned ionic or nonionic surfactants.

Various known colorants or pigments present in the toner in an effective amount of, for example, from about 1 to about 25 percent by weight of the toner, and preferably in an amount of from about 1 to about 15 weight percent that can be selected include carbon black like REGAL 330®; magnetites, such as Mobay magnetites MO8029™, MO8060™; Columbian magnetites; MAPICO BLACKS™, and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020198 , PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D.

TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like boron, aluminum, zinc and chromium complexes of salicylic acids, and the like.

Surfactants in amounts of, for example, 0.1 to about 25 weight percent in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890TM, IGEPAL CO-720™, IGEPAL CO-290™, IGEPAL CA-210™, ANTAROX 890™ and ANTAROX 897™. An effective concentration of the nonionic surfactant is in embodiments, for example, from about 0.01 to about 10 percent by weight, and preferably from about 0.1 to about 5 percent by weight of monomers used in latex emulsion preparation.

Examples of ionic surfactants include anionic and cationic surfactants with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the latex emulsions.

Examples of the cationic surfactants selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to 4, and preferably from 0.5 to 2.

Examples of additional optional surfactant, which is added to the aggregated suspension to primarily stabilize the aggregates from further growing in size during the coalescence, can be selected from anionic surfactants of, for example, sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. It can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as an aggregate stabilizer is, for example, from about 0.01 to about 10 percent by weight, and preferably from about 0.5 to about 5 percent by weight of the total weight of the aggregate suspension comprised of latex and pigment particles, optional charge control agent, water, ionic and nonionic surfactants.

Surface additives that can be added to the toner compositions after washing or drying include, for example, metal salts, metal salts of fatty acids, colloidal silicas, silicas, coated silicas, metal oxides, like titanium dioxide, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation or washing process, or blended into the final toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. 4,265,660, the disclosure of which is totally incorporated herein by reference.

The following Examples are being submitted to further define various species of the present invention. These Examples are intended to be illustrative only and are not intended to limit the scope of the present invention.

EXAMPLE I

A latex emulsion (a) comprised of linear polymer particles derived from emulsion polymerization of styrene, butyl acrylate and acrylic acid was prepared as follows. An organic phase was prepared by blending 492.0 grams of styrene, 108.0 grams of butyl acrylate, 12.0 grams of acrylic acid, 6.0 grams of carbon tetrabromide and 18.0 grams of dodecanethiol. An aqueous phase was prepared by mixing an aqueous solution of 6.0 grams of ammonium persulfate in 200 milliliters of water with 700 milliliters of an aqueous solution of 13.5 grams of anionic surfactant, NEOGEN R™ (which contains 60 weight percent of active sodium dodecyl benzene sulfonate in water), and 12.9 grams of nonionic surfactant, ANTAROX CA 897™ (which contains 70 weight percent of active polyoxyethylene nonyl phenyl ether in water). The organic phase was then added to the aqueous phase, and homogenized at room temperature, about 25° C. throughout, while purging with nitrogen at about 20° C. for 30 minutes. Subsequently, the mixture resulting was stirred and heated to 70° C. at a rate of 1° C. per minute, and retained at this temperature for 6 hours. The resulting latex polymer displayed an $M_w$ of 25,900, an $M_n$, of 5,400, and a mid-point Tg of 55.9° C.

Another latex emulsion (b) comprised of crosslinked polymer particles was prepared in accordance with the above procedure from 270.0 grams of styrene, 30.0 grams of divinyl benzene, 300.0 grams of butyl acrylate, and 12.0 grams of acrylic acid with the exception that the chain transfer agents, carbon tetrabromide and dodecanethiol, were excluded.

234.0 Grams of the latex emulsion (a), 26.0 grams of the latex emulsion (b), and 230.0 grams of an aqueous cyan pigment dispersion containing 4.0 grams of dispersed Cyan Pigment 15:3, and 2.6 grams of the cationic surfactant, SANIZOL B™, were simultaneously added to 400 milliliters of water with high shear stirring by means of a polytron. The mixture was transferred to a 2 liter reaction vessel and heated at a temperature of 50° C. for 1.0 hour before 20 milliliters of 20 percent aqueous NEOGEN R™ solution were added. Subsequently, the mixture was heated to 95° C. and retained at this temperature for a period of 4 hours. The resulting toner product was filtered, washed with water, and dried in a freeze dryer. The resulting toner comprised of about 86.7 weight percent of the linear polymer resin, about 9.6 weight percent of the crosslinked polymer resin, or particles, and about 3.7 weight percent of the Cyan Pigment 15:3 evidenced a particle size of 6.7 microns in volume average diameter and a GSD of 1.20 as measured with a Coulter Counter.

Standard fusing properties of the prepared toner were evaluated as follows. Unfused images of the toner on paper with a controlled toner mass per unit area of 1.2 milligrams/$cm^2$ were produced in accordance with the following procedure. A suitable electrophotographic developer was generated by mixing from 2 to 10 percent by weight of the toner with a suitable electrophotographic carrier, such as, for example, a 90 micron diameter ferrite core, spray coated with 0.5 weight percent of a terpolymer of poly(methyl methacrylate), styrene, and vinyltriethoxysilane, and roll milling the mixture for 10 to 30 minutes to produce a tribocharge of between −5 to −20 microcoulombs per gram of toner as measured with a Faraday Cage. The developer was then introduced into a small electrophotographic copier, such as Mita DC-111, in which the fuser system had been disconnected. Between 20 and 50 unfused images of a test pattern of a 65 millimeter by 65 millimeter square solid area were produced on 8 ½ by 11 inch sheets of a typical electrophotographic paper such as Xerox Image LX© paper.

The unfused images were then fused by feeding them through a hot roll fuser system comprised of a fuser roll and pressure roll with VITON surfaces, both of which were heated to a controlled temperature. Fused images were produced over a range of hot roll fusing temperatures of from about 120° C. to about 210° C. The gloss value of the fused images was measured according to TAPPI Standard T480 at a 75° angle of incidence and reflection using a Novo-Gloss©Statistical Glossmeter, Model GL-NG1002S from Paul N. Gardner Company, Inc. The degree of permanence of the fused images was evaluated by the known Crease Test. The fused image was folded under a specific weight with the toner image to the inside of the fold. The image was then unfolded and any loose toner wiped from the resulting crease with a cotton swab. The average width of the paper substrate which shows through the fused toner image in the vicinity of the crease was measured with a custom built image analysis system.

The fusing performance of a toner is traditionally judged from the fusing temperature required to achieve acceptable image gloss and fix. For different applications varying image gloss is required. The minimum fuser temperature required to produce a crease value less than the maximum acceptable crease of traditionally 65 crease units, is known as the Minimum Fix Temperature (MFT) for a given toner. The gloss level attained at this temperature will dictate the gloss of the final image.

The toner obtained in this Example was evaluated in accordance with the above, and an MFT of 150° C., and a gloss value of 48 GGU at that temperature were obtained.

EXAMPLE II 257.0 Grams of the latex emulsion (a) and 3.0 grams of latex emulsion (b) from Example I, and 230.0 grams of aqueous cyan 15:1 pigment dispersion of the Example I, and 2.6 grams of the SANIZOL B™ were simultaneously added to 400 milliliters of water with high shear stirring by means of a polytron. The mixture was transferred to a 2 liter reaction vessel and heated at a temperature of 50° C. for 1.5 hour before 28 milliliters of 20 percent aqueous NEOGEN R™ solution were added. Subsequently, the mixture was heated to 95° C. and retained at this temperature for a period of 5 hours, before cooling down to room temperature and filtered. The resulting toner was washed with water and dried in a freeze dryer. The toner product obtained comprised about 95.2 weight percent of the linear polymer resin, 1.1 weight percent of crosslinked polymer particles, and about 3.7 weight percent of the cyan pigment evidenced a particle size of 6.6 microns in volume average diameter, with a GSD of 1.20 as measured with a Coulter Counter. The prepared toner, when evaluated in accordance with the procedure of Example I, exhibited an MFT of 150° C. and a gloss value of 65 GGU at that temperature.

EXAMPLE III

A latex emulsion (c) comprised of crosslinked polymer particles was prepared from 390.0 grams of styrene, 30.0 grams of divinyl benzene, 180 grams of butyl acrylate, and 12.0 grams of acrylic acid in accordance with the procedure for the preparation of latex emulsion (b) as described in Example I.

78.0 Grams of the latex emulsion (c), 182.0 grams of the latex emulsion (a) from Example I and 230.0 grams of an aqueous cyan 15:3 pigment dispersion of Example I, and 2.6 grams of cationic surfactant, SANIZOL B™, were simultaneously added to 400 milliliters of water with high shear stirring by means of a polytron. The resulting mixture was then transferred to a 2 liter reaction vessel and heated at a temperature of 53° C. for 2.0 hours before 35 milliliters of 20 percent aqueous NEOGEN R™ solution were added. Subsequently, the mixture was heated to 95° C. and retained at this temperature for a period of 4 hours, before cooling down to room temperature. The resulting toner was filtered, washed with water, and dried in an oven. The resulting toner product, comprised of about 67.4 weight percent of the liner polymer, about 28.9 weight percent of the crosslinked polymer, and about 3.7 weight percent of 15:3 cyan pigment showed a particle size of 7.0 microns in volume average diameter with a GSD of 1.22 as measured with a Coulter Counter. When evaluated in accordance with the procedure of Example I, the toner displayed an MFT of 154° C. (Centigrade throughout) and a gloss value of 24 GGU at that temperature.

EXAMPLE IV 182.0 Grams of the latex emulsion (a) from Example I, 120.0 grams of the latex emulsion (c) from Example III, 230.0 grams of the aqueous cyan 15:3 pigment dispersion of Example I, and 2.6 grams of cationic surfactant, SANIZOL B™, were simultaneously added to 400 milliliters of water with high shear stirring by means of a polytron. The mixture was transferred to a 2 liter reaction vessel and heated at a temperature of 50° C. for 2.0 hours before 27 milliliters of 20 percent aqueous NEOGEN R™ solution were added. Subsequently, the mixture was heated to 95° C. and retained at this temperature for a period of 3.5 hours before cooling down to room temperature. The resulting toner with the above linear polymer, the above crosslinked polymer, and the above cyan pigment was filtered, washed with water, and dried in an oven. The resulting toner product contained about 59.3 weight percent of the linear polymer, about 37 weight percent of the crosslinked polymer, and about 3.7 weight percent of the 15:3 cyan pigment, evidenced a particle size of 6.7 microns in volume average diameter with a GSD of 1.18 as measured with a Coulter Counter. When evaluated in accordance with the procedure of Example I, the above toner displayed an MFT of 154° C. and a gloss value of 17 GGU at that temperature.

EXAMPLE V

A latex emulsion (d) comprised of crosslinked polymer particles was prepared from 462.0 grams of styrene, 30.0 grams of divinyl benzene, 108.0 grams of butyl acrylate, and 12.0 grams of acrylic acid in accordance with the procedure for the preparation of latex emulsion (b) as described in Example I.

130 Grams of the latex emulsion (d), 130.0 grams of the latex emulsion (a) from Example I, 230.0 grams of the 15:3 cyan aqueous pigment dispersion of Example I, and 2.6 grams of cationic surfactant, SANIZOL B™ were simultaneously added to 400 milliliters of water with high shear stirring by means of a polytron. The resulting mixture was transferred to a 2 liter reaction vessel and heated at a temperature of 53° C. for 2.0 hours before 35 milliliters of 20 percent aqueous NEOGEN R™ solution were added. Subsequently, the mixture was heated to 95° C. and retained for a period of 4 hours before cooling down to room temperature. There was obtained a toner product with about 48.1 weight percent of the above linear polymer, about 48.1 weight percent of the above crosslinked polymer, and about 3.7 weight percent of the cyan pigment 15:3, after it was filtered, washed with water, and dried in an oven. The toner showed a particle size of 7.2 microns in volume average diameter with a GSD of 1.23 as measured with a Coulter Counter. When evaluated in accordance with the procedure of Example I, this toner exhibited an MFT of 155° C. and a gloss value of 10 GGU at that temperature.

EXAMPLE VI 208.0 Grams of the latex emulsion (a) from Example I, 52.0 grams of the latex emulsion (d) from Example V, and 230.0 grams of the cyan 15:3 aqueous pigment dispersion of Example I, and 2.6 grams of cationic surfactant, SANIZOL B™, were simultaneously added to 400 milliliters of water with high shear stirring by means of a polytron. The mixture was transferred to a 2 liter reaction vessel and heated at a temperature of 53° C. for 2.0 hours before 35 milliliters of 20 percent aqueous NEOGEN R™ solution were added. Subsequently, the mixture was heated to 95° C. and held there for a period of 4 hours, followed by cooling down to room temperature. The resulting toner was filtered, washed with water, and dried by freeze drying. This toner, which was comprised of about 77 weight percent of the linear polymer, about 19.3 weight percent of the crosslinked polymer, and about 3.7 weight percent of the cyan pigment 15:3, displayed a particle size of 6.9 microns in volume average diameter with a GSD of 1.21 as measured with a Coulter Counter. When evaluated in accordance with the procedure of Example I, the toner showed an MFT of 151° C. and a gloss value of 35 GGU at that temperature.

Other modifications of the present invention may occur to those of ordinary skill in the art subsequent to a review of the present application and these modifications, including equivalents thereof, are intended to be included within the scope of the present invention.

What is claimed is:

1. A process for the preparation of toner comprising (i) blending (a) an aqueous colorant dispersion containing a first ionic surfactant and an optional charge control agent with (b) a latex blend comprised of linear polymer and crosslinked polymer particles, optional nonionic surfactant and a second ionic surfactant with a charge polarity opposite to that of said first ionic surfactant in said pigment dispersion;

(ii) heating the resulting mixture at about below the glass transition temperature (Tg) of the linear latex polymer to form toner sized aggregates; and (iii) subsequently heating said aggregate suspension about above the Tg of the linear latex polymer to effect fusion or coalescence of said aggregates.

2. A process in accordance with claim 1 wherein the temperature at which the aggregates are formed in (ii) controls the size of said aggregates to be in the range of from about 2 to about 10 microns in volume average diameter, and wherein said coalescence of (iii) provides mechanically stable integral toner particles.

3. A process in accordance with claim 1 wherein the crosslinked polymer is a crosslinked linear polymer.

4. A process in accordance with claim 1 wherein the crosslinked polymer is selected from the group consisting of a crosslinked poly(styrene-alkyl acrylate), poly(styrene-butadiene), poly(styrene-isoprene), poly(styrene-alkyl methacrylate), poly(styrene-alkyl acrylate-acrylic acid), poly(styrene-butadiene-acrylic acid), poly(styrene-isoprene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly (styrene-alkyl acrylate-acrylonitrile-acrylic acid), and a crosslinked poly(alkyl acrylate-acrylonitrile-acrylic acid).

5. A process in accordance with claim 1 wherein the crosslinked polymer particles are present in an amount of from about 0.1 to about 70 weight percent, or preferably from about 1 to about 50 weight percent of the toner.

6. A process in accordance with claim 1 wherein the crosslinked polymer particles are present in an amount of from about 20 to about 50 weight percent of the toner.

7. A process in accordance with claim 1 wherein the linear polymer is present in an amount of from about 25 to about 95 weight percent of the toner.

8. A process in accordance with claim 1 wherein the linear polymer is present in an amount of from about 50 to about 90 weight percent of the toner.

9. A process in accordance with claim 1 wherein the resulting toner has an image gloss value of from about 5 to about 60 GGU at the toner's minimum fix temperature (MFT), which temperature is from about 120° to about 185° C.

10. A process in accordance with claim 1 wherein the toner possesses an image gloss value of from about 10 to about 70 GGU at the toner MFT of from about 120° to about 185° C., and which gloss value is enabled by the presence of from about 0.1 to about 70 weight percent of crosslinked polymer particles in the toner.

11. A process in accordance with claim 1 wherein the surfactant in the aqueous colorant dispersion is a cationic surfactant, and the surfactant in the latex blend is nonionic and anionic surfactants.

12. A process in accordance with claim 1 wherein the surfactant in the colorant dispersion is an anionic surfactant and the surfactant in the latex blend is nonionic and cationic surfactants.

13. A process in accordance with claim 1 wherein the aqueous colorant dispersion is prepared by homogenizing a colorant in water in the presence of a suitable surfactant, which homogenizing is at from about 1,000 revolutions per minute to about 10,000 revolutions per minute, at a temperature of from about 25° C. to about 55° C., and for a duration of from about 1 minute to about 120 minutes.

14. A process in accordance with claim 1 wherein the colorant dispersion is prepared by mixing a colorant in a suitable surfactant in water using an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

15. A process in accordance with claim 1 wherein the aggregation step (ii) is accomplished at temperatures of from about 25° C. to about 1° C. below the Tg of the linear polymer for a duration of from about 0.5 hour to about 6 hours.

16. A process in accordance with claim 1 wherein the linear polymer is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly (styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly (butyl methacrylate-acrylic acid), poly(styrene-butyl acrylate-acrylonitrile-acrylic acid), poly(acrylonitrile-butyl acrylate-acrylic acid), and the crosslinked polymer is comprised of said linear polymer with crosslinking.

17. A process in accordance with claim 1 wherein the linear polymer is poly(styrene-butylacrylate), poly(styrene-butyl acrylate-acrylic acid), poly(styrene-butadiene), poly (styrene-butadiene-acrylic acid), poly(styrene-butyl acrylate-acrylonitrile), or poly(styrene-butyl acrylate-acrylonitrile-acrylic acid), and the crosslinked resin is the crosslinked derivative of poly(styrene-butyl acrylate), poly (styrene-butyl acrylate-acrylic acid), poly(styrene-butadiene), poly(styrene-butadiene-acrylic acid), poly (styrene-butyl acrylate-acrylonitrile), or poly(styrene-butyl acrylate-acrylonitrile-acrylic acid).

18. A process in accordance with claim 2 wherein the linear polymer is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly (styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly (butyl methacrylate-acrylic acid), poly(styrene-butyl acrylate-acrylonitrile-acrylic acid), poly(acrylonitrile-butyl acrylate-acrylic acid), and wherein the crosslinked polymer is contained in said linear polymer.

19. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

20. A process in accordance with claim 1 wherein the anionic surfactant is selected from the group consisting of sodium dodecyl sulfate, sodium dodecylbenzene sulfate, sodium dodecylnaphthalene sulfate, and the cationic surfactant is a quaternary ammonium salt.

21. A process in accordance with claim 1 wherein the colorant is carbon black, magnetite, cyan, yellow, magenta colorant, and mixtures thereof.

22. A process in accordance with claim 1 wherein the surfactants are each present in an effective amount of from about 0.1 to about 5 weight percent of the reaction mixture.

23. A process in accordance with claim 1 wherein there is added to the surface of the formed toner metal salts, metal salts of fatty acids, silicas, metal oxides, or mixtures thereof, in an effective amount of from about 0.1 to about 10 weight percent of the obtained toner particles.

24. A process in accordance with claim 1 wherein the toner is washed with water or aqueous base at a temperature of from about 25° to about 75° C. primarily to remove the residual surfactants from the toner.

25. A process in accordance with claim 1 wherein the fusion or coalescence (iii) is accomplished at a temperature from about 10 to about 50° C. above the Tg of the linear noncrosslinked resin, and wherein the heating in the coalescence (iii) is accomplished at a temperature of about 80° to about 100° C.

26. A process for the preparation of toner comprising heating (a) a mixture of an aqueous colorant dispersion containing a first ionic surfactant, and (b) a latex blend comprised of linear noncrosslinked polymer and crosslinked polymer particles, a non-ionic surfactant and a second ionic surfactant with a charge polarity opposite to that of said first ionic surfactant in said pigment dispersion; heating the resulting mixture below the glass transition temperature (Tg) of the linear noncrosslinked polymer to form toner aggregates; and subsequently heating said aggregates above the Tg of the linear latex polymer to effect coalescence of said aggregates.

27. A toner obtained by the process of claim 1.

28. A toner obtained by the process of claim 26.

29. A process in accordance with claim 1, wherein subsequent to (iii) the aggregate suspension is cooled, the toner recovered, and thereafter washed and dried.

30. A process in accordance with claim 26, wherein the toner is cooled, recovered, and thereafter washed and dried.

31. A process for the preparation of toner consisting essentially (i) blending (a) an aqueous colorant dispersion containing a first ionic surfactant and an optional charge control agent with (b) a latex blend comprised of linear polymer and crosslinked polymer particles, optional non-ionic surfactant and a second ionic surfactant with a charge polarity opposite to that of said first ionic surfactant in said pigment dispersion;

(ii) heating the resulting mixture at about below the glass transition temperature (Tg) of the linear latex polymer to form toner sized aggregates;

(iii) subsequently heating said aggregate suspension about above the Tg of the linear latex polymer to effect fusion or coalescence of said aggregates; and (iv) cooling and isolating the toner product.

* * * * *